US006745412B1

(12) United States Patent
Egeresi

(10) Patent No.: US 6,745,412 B1
(45) Date of Patent: Jun. 8, 2004

(54) PERSONAL SAUNA IN SHOWER OR IN BATHTUB ENCLOSURE

(75) Inventor: Zoltan Egeresi, 5500 Coast Rd., Santa Cruz, CA (US) 95060

(73) Assignee: Zoltan Egeresi, Santa Cruz, CA (US)

( * ) Notice: Subject to any disclaimer, the term of this patent is extended or adjusted under 35 U.S.C. 154(b) by 0 days.

(21) Appl. No.: 10/336,314

(22) Filed: Jan. 6, 2003

(51) Int. Cl.[7] ..... A61H 33/06

(52) U.S. Cl. ..... 4/524; 4/527; 4/531; 4/532; 4/534; 4/535; 4/536; 4/537

(58) Field of Search ..... 4/524, 527, 531, 4/532, 534, 535, 536, 537, 598, 599; 135/91, 92

(56) References Cited

U.S. PATENT DOCUMENTS 1,710 A * 7/1840 Warren ..... 4/534
5,416,931 A * 5/1995 Wolfenden et al. ..... 4/524
5,511,254 A * 4/1996 O'Brien ..... 4/532
5,950,254 A * 9/1999 Yasue ..... 4/524
6,510,565 B1 * 1/2003 Zwezdaryk ..... 4/531
6,675,403 B2 * 1/2004 Akhtar et al. ..... 4/526

* cited by examiner

*Primary Examiner*—Henry Bennett
*Assistant Examiner*—Azadeh Kokabi

(57) ABSTRACT

A portable and personal sauna that provides an inexpensive and easy to operate system, which provides steam with low operating costs. The portable sauna has an electric steamer with a timer, a safety thermostat, and a plate for containing herbs. When steam passes through the herb plate, the herbal steam can provide some healthy benefits to users. The preferable and safest place for the steamer is outside of the tub/shower area, where a flexible tube is used to guide the steam inside the tub/shower area.

3 Claims, 2 Drawing Sheets

PERSONAL SAUNA IN SHOWER OR IN BATHTUB ENCLOSURE

FIELD OF THE INVENTION

This invention relates to a personal sauna, in particular to a personal sauna used in combination with a bathtub or shower enclosure.

BACKGROUND OF THE INVENTION

Sauna is a great way for relaxation and enjoyment. However, most apartments and houses do not have adequate room for a permanent or capsule-type sauna. Known sauna capsules are expensive, cumbersome to install, and take up a great deal of space. Furthermore, such sauna systems gives users a claustrophobic feeling of being in a small and confined area.

Accordingly, it is an object of this invention to provide a personal sauna system overcoming the shortcoming of the prior art.

It is a further object of this invention to provide a personal steam bath that does not occupy a great deal of space and is easy to store and may be used with a shower or bathtub enclosure.

SUMMARY OF THE INVENTION

The present invention converts a bathtub or shower enclosure into a low cost sauna. The assembly uses a plastic retractable cover member above the shower to close off the tub/shower area while the steamer is being used. After using the enclosed area as a sauna, the retractable cover member is moved and the sauna can be converted back into a tub/shower enclosure. Conversion time takes only seconds, and this sauna needs only minimal storage space.

The present invention utilizes an electric steamer, which is preferably placed outside of the shower or bathtub enclosure. A flexible hose extending from one end of the steamer is inserted inside the enclosure to provide steam. Herbs, such as lavender and camellia can be placed on an herb plate or tray for an enjoyable, healthy, and relaxing sauna experience. The personal sauna uses electricity or gas to bring water to the boiling temperature to create steam and further utilizes a timer and thermostat to safely control the operation of the sauna.

BRIEF DESCRIPTION OF THE DRAWINGS

Further objects and advantages will become apparent upon reading the following detailed description in conjunction with the drawings in which.

DETAILED DESCRIPTION OF THE PREFERRED EMBODIMENT

Figure 1:
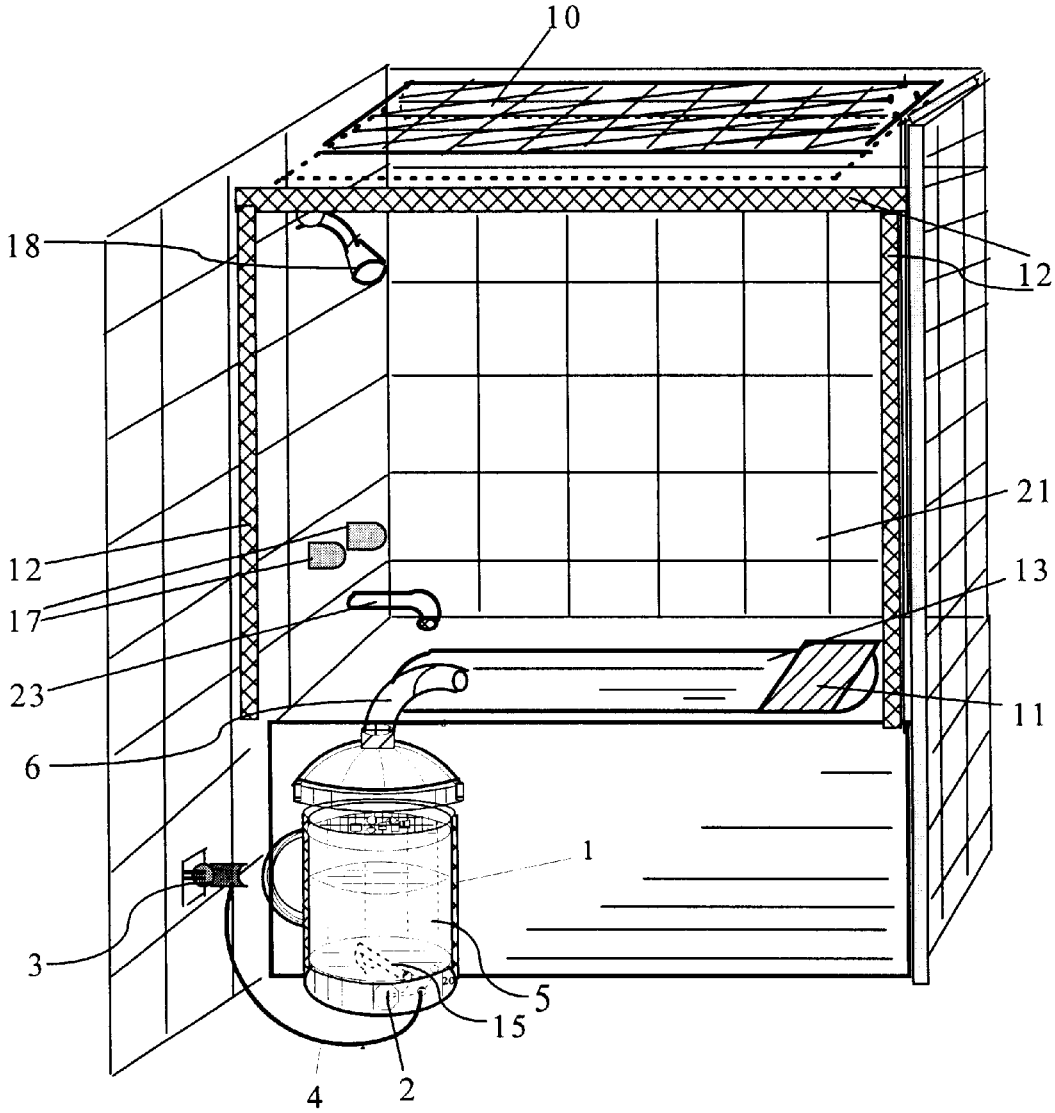
FIG. 1 is a perspective view of an electric steamer next to a bathtub wherein a flexible plastic hose extends from the steamer into the bathtub. A top retractable plastic cover enclosure is also shown in this figure.
Figure 2:
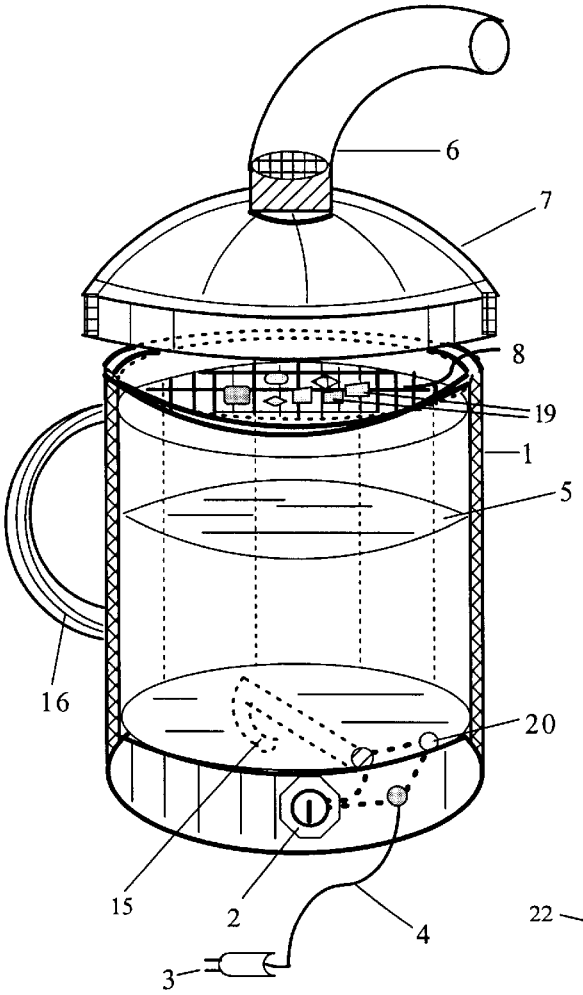
FIG. 2 shows an electric steamer in a perspective view with an herb plate or tray a containing herbs, including medicated herbs. The steamer also contains a steam hood and a handle.

A portable, personal sauna according to the present invention is generally illustrated in FIGS. 1 and 2. FIG. 1 illustrates an electric steamer 1 positioned next to a bathtub 13. The bathtub 13 has at least three tiled side walls 21, sliding door frames 12 (not shown), hot and cold valves 17, shower head 18, and a tub water outlet 23. The bathtub 13 may be converted into a sauna by closing the sliding door frames 12 (not shown) and moving a retractable plastic cover 10 to a closed position. The top of the bathtub 13 is closed with the retractable plastic cover 10 to keep the steam inside the bathtub enclosure. The bathtub has a piece of redwood 11, which serves as a temporary and removable seat.

FIG. 2 shows the electric steamer in a perspective view. The steamer 1 has a bottom end, a middle portion, and a top end. The steamer 1 is a stainless steel container. It contains a handle 16 for easy transportation. The middle portion has a body that contains a volume of water. The bottom portion contains a heating element 15, a thermostat 20, and a timer 2. The heating element 15 uses 1,000–1,500 Watts or 110–220 Volts of energy to bring the water in the middle portion to a boil. The timer 2 is used for turning on and controlling the time interval during which the heating element will operate. The thermostat 20 acts as a safety device and is used to cut off electrical power to prevent overheating of the sauna if all or a majority of the total volume of water in said middle portion evaporates.

The electric steamer of FIG. 2 has an herb plate or tray 8 that contains herbs such as lavender and camellia. The steam generated by boiling the water in the middle portion guides the herbal aroma into the bathtub enclosure. A steam hood 7 is placed on the top end of the steamer 1. The steam hood is fitted on the electric steamer housing. It contains a fitting in which a flexible tubing 6 is extended.

As illustrated in FIG. 1, the steamer is placed a distance away from the bathtub 13 and the flexible tubing 6 has a length sufficient to extend from the top end of the steamer into the bathtub 13 to produce steam in the enclosed bathtub area.

Figure 3:
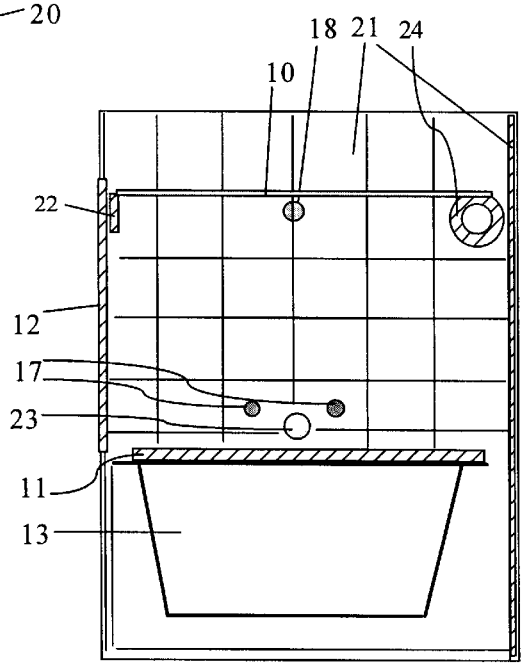
FIG. 3 shows a rear view of the bathtub/shower enclosure with a retractable cover. A smooth redwood board on the tub is used as a seat for one or two users. A wooden stool could be used in a shower area only.

FIG. 3 shows the rear view of the bathtub with a top cover 10 fully extended and hooked onto hooks 22. When steam is not needed, the top cover 10 rolls back onto spring loaded cylindrical rollers 24.

While the invention has been described in connection with what is presently considered to be the most practical and preferred embodiment, it is to be understood that the invention is not limited in its application to the details of construction and to the arrangements of the components set forth in the description or the illustration in the drawings.

What is claimed is:

1. A portable steam sauna comprising:

a bathtub or shower enclosure surrounded by at least three walls and at least one slideable door frame for closing a doorway, said enclosure having a top comprising a plastic retractable cover assembly;

said cover assembly is movable along a spring loaded cylindrical roller to open and close the top of the enclosure; the cover assembly is held in a closed position by at least one hook-like element when in a closed position;

an electric steamer having a stainless steel housing; said housing having a bottom end, a middle portion, and a top end;

said middle portion having a body for containing a volume of water;

said bottom end of the steamer housing comprises a heating element wherein said heating element produces steam by heating the water in the middle portion of the electric steamer;

wherein said steamer is placed a distance from the bathtub or shower enclosure and is connected to an electrical circuit by an electrical cord; said steamer having a thermostat for cutting off electrical power to prevent over heating of sauna if a substantial amount of the total volume of water in said middle portion evaporates; said steamer having a timer for turning on and controlling the time interval during which the heating element will operate;

said top portion of the steamer having a plate dimensioned to fit on said top end, said plate having an area for placement of herbs and aromatherapy products; wherein the steam evaporated by the heating element extracts aromas from said herbs;

said top portion having a hood which is fitted on the top portion of said steamer, the hood having a tubular fitting for a flexible hose, said flexible hose has a length sufficient to extend from said steamer into the bathtub or shower enclosure.

2. A portable steamer as claimed in claim 1 further including at least one seat or stool within said enclosure.

3. A portable steamer as claimed in claim 1 further including at least one handle attached to the steamer housing.

* * * * *